US008665157B2

(12) United States Patent
Chiang

(10) Patent No.: US 8,665,157 B2
(45) Date of Patent: Mar. 4, 2014

(54) ANTENNA STRUCTURE

(75) Inventor: Chi-Ming Chiang, Taoyuan County (TW)

(73) Assignee: Auden Techno Corp., Taoyuan County (TW)

( * ) Notice: Subject to any disclaimer, the term of this patent is extended or adjusted under 35 U.S.C. 154(b) by 349 days.

(21) Appl. No.: 13/071,593

(22) Filed: Mar. 25, 2011

(65) Prior Publication Data

US 2012/0242545 A1 Sep. 27, 2012

(51) Int. Cl.
*H01Q 1/38* (2006.01)

(52) U.S. Cl.
USPC ..... 343/700 MS; 343/906

(58) Field of Classification Search
USPC ..... 343/700 MS, 906
See application file for complete search history.

(56) References Cited

U.S. PATENT DOCUMENTS

2009/0231200 A1* 9/2009 Chiu et al. ..... 343/700 MS
2010/0134382 A1* 6/2010 Liu et al. ..... 343/906

* cited by examiner

*Primary Examiner* — Allyson Trail
(74) *Attorney, Agent, or Firm* — Li & Cai Intellectual Property (USA) Office

(57) ABSTRACT

An antenna structure includes a microwave substrate, a main-antenna unit, an extension grounding unit. The main antenna unit is arranged on the surface of the microwave substrate. The main antenna unit includes a main-radiation portion, a main-feeding portion, a main-grounding portion. The extension grounding unit is arranged on the surface of the microwave substrate. The extension grounding unit includes a first extension grounding portion and a second extension grounding portion. The antenna structure can adjust the radiation pattern and improve the antenna directivity. The main-antenna unit and the sub-antenna unit share the extension grounding unit in common. So, the antenna structure can reduce the antenna occupied volume and save the mass production cost.

8 Claims, 5 Drawing Sheets

ANTENNA STRUCTURE

BACKGROUND OF THE INVENTION

1. Field of the Invention

The instant disclosure relates to an antenna structure, and more particularly, to an antenna structure for wireless communication signal receiving and transmitting.

2. Description of Related Art

Wireless communication devices have deeply proliferated in our modern life. These devices usually include an antenna unit for enabling signal reception and transmission. The transmitting and receiving quality of the antenna unit is often a buyer's first practical consideration factor when determining whether or not to purchase a particular wireless device.

Poor antenna performance, such as poor voice quality, unstable wireless network, and signal delays in the mobile communication systems, will likely result in consumers' unwillingness to purchase. Therefore, improving the performance of the transmitting and receiving quality is often the primary objective for antenna research.

One particular technical difficulty to be overcome in the existing miniature antenna units is poor antenna directivity. The narrow directional coverage in conventional antenna units may result in poor transmission and/or reception of wireless signals in certain directions.

Based on research and related industrial experience, the inventor proposes the following solution to address the above issues.

SUMMARY OF THE INVENTION

The object of the instant disclosure is to provide an antenna structure that has excellent antenna radiation performance.

One aspect of the instant disclosure is to provide an antenna structure, which includes a microwave substrate, a main-antenna unit, an extension grounding unit. The main antenna unit arranged on the surface of the microwave substrate. The main antenna unit includes a main-radiation portion, a main-feeding portion, and a main-grounding portion. The extension grounding unit is arranged on the surface of the microwave substrate. Furthermore, the extension grounding unit includes a first extension grounding portion and a second extension grounding portion.

Another aspect of the instant disclosure is to provide an antenna structure, which includes a microwave substrate, a main-antenna unit, a sub-antenna unit, and an extension grounding unit. The main antenna unit arranged on the surface of the microwave substrate. The main antenna unit includes a main-radiation portion, a main-feeding portion, and a main-grounding portion. The sub-antenna unit arranged on the surface of the microwave substrate. The sub-antenna unit includes a sub-radiation portion, and a sub-feeding portion. The extension grounding unit is arranged on the surface of the microwave substrate. The extension grounding unit includes a first extension grounding portion and a second extension grounding portion.

The instant disclosure offers the following advantage: because the antenna structure has the extension grounding unit, the antenna structure can adjust the radiation pattern and improve the antenna directivity. Moreover, because the main-antenna unit and the sub-antenna unit share the same extension grounding unit, the instant antenna structure may be designed to have a smaller physical signature and manufactured at a lower mass production cost.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
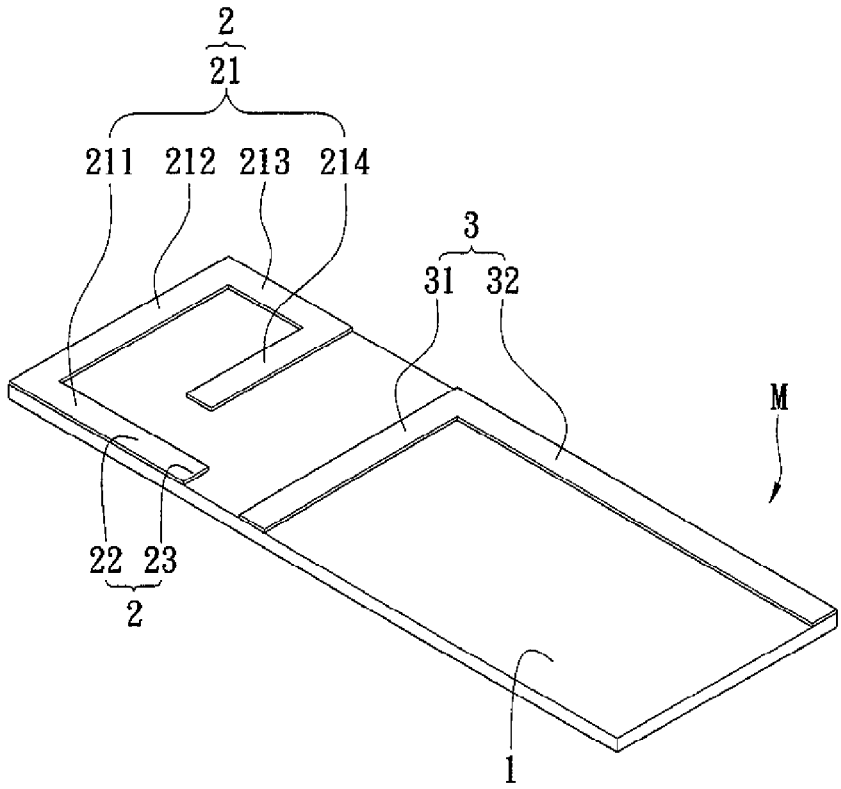
FIG. 1 shows a stereogram to the first embodiment of the instant disclosure.

Please refer to the FIG. 1, which show the first embodiment of the instant disclosure for an antenna structure M. The antenna structure M includes a microwave substrate 1, a main-antenna unit 2, and an extension grounding unit 3.

The main-antenna unit 2 is disposed on the surface of the microwave substrate 1. The main-antenna unit 2 has a main-radiation portion 21, a main-feeding portion 22, a main-grounding portion 23. The main-grounding portion 23 is arranged on the distal portion of the main-antenna unit 2 in the close proximity of the main-feeding portion 22. The main-feeding portion 22 can be connected to a 50Ω coaxial cable. Thus, both the received signal and the transmitted signal from the main-radiation portion 21 can be delivered through the 50Ω coaxial cable. The function of the main-grounding portion 23 is to enhance antenna impedance matching and thus increase antenna efficiency.

The main-radiation portion 21 includes a first section 211, a second section 212, a third section 213, and a fourth section 214. The second section 212 is connected to the terminal portion of the first section 211. The second section 212 is perpendicular to the first section 211. The third section 213 is connected to the terminal portion of the second section 212. The third section 213 is perpendicular to the second section 212, and the third section 213 is parallel to the first section 211. The fourth section 214 is connected to the terminal portion of the third section 213. The fourth section 214 is perpendicular to the third section 213, and the fourth section 214 will be parallel to the second section 212.

The extension grounding unit 3 is arranged on the surface of the microwave substrate 1 at a predetermined distant from the main-antenna unit 2. The extension grounding unit 3 includes a first extension grounding portion 31 and a second extension grounding portion 32. The second extension grounding portion 32 is connected to the terminal portion of the first extension grounding portion 31. Particularly, the extension grounding unit 3 resembles a substantially L-shaped structure. In addition to the main-grounding portion 23, the instant disclosure further employs an extension grounding unit 3 to improve the characteristic of the antenna structure M. The extension grounding unit 3 may enable adjustment to the radiation pattern of the antenna structure M and improve the antenna directivity.

The microwave substrate 1 is preferably made from insulating materials, and can be 0.3 mm to 1 mm in thickness. The main-antenna unit 2 and the extension grounding unit 3 are made from the metallic micro-strip, and can be 0.1 mm to 0.3 mm in thickness. The main-antenna unit 2 can be used in Global Positioning System, which can receive and transmit the signal between 1565 MHz and 1585 MHz.

Figure 2:
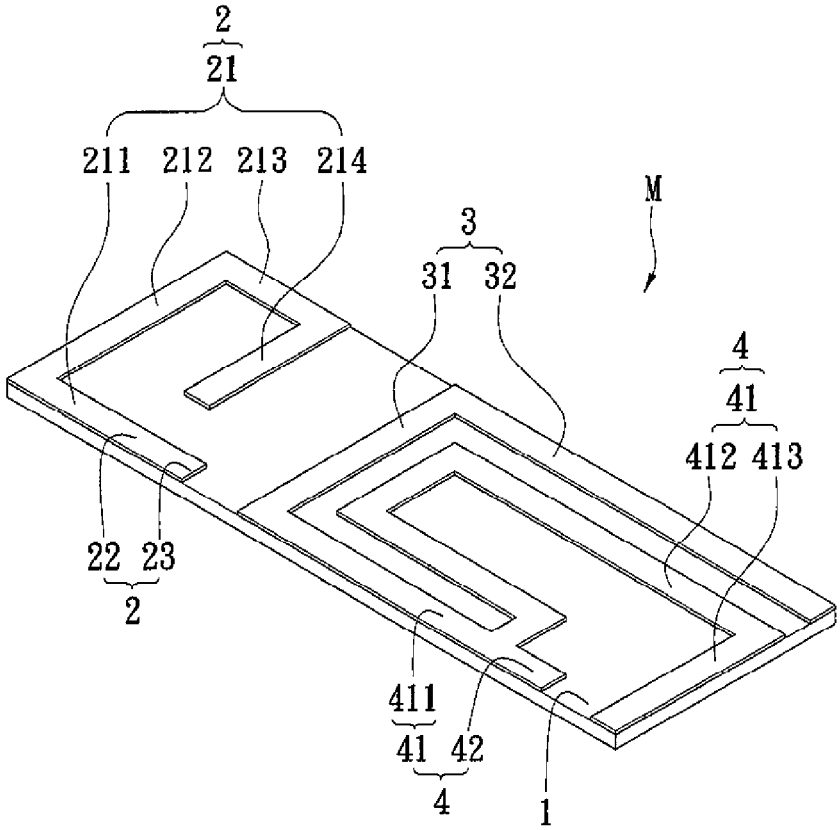
FIG. 2 shows a stereogram to the second embodiment of the instant disclosure.

Please refer to the FIG. 2, which shows the second embodiment of the instant disclosure for an antenna structure M. The antenna structure M includes a microwave substrate 1, a main-antenna unit 2, an extension grounding unit 3, and a sub-antenna unit 4. The main antenna unit 2 and the extension grounding unit 3 are arranged on the surface of the microwave substrate 1. The main antenna unit 2 includes a main-radiation portion 21, a main-feeding portion 22, a main-grounding portion 23. The extension grounding unit 3 includes a first extension grounding portion 31 and a second extension grounding portion 32.

The microwave substrate 1, the main-antenna unit 2, and the extension grounding unit 3 are the same as the first embodiment.

The sub-antenna unit 4 is arranged on the surface of the microwave substrate 1, which is arranged in close proximity to the extension grounding unit 3. The sub-antenna unit 4 includes a sub-radiation portion 41 and a sub-feeding portion 42.

The sub-radiation portion 41 includes a sub-extended segment 411, a sub-bent segment 412, and a sub-distal segment 413. The sub-bent segment 412 is connected to the terminal portion of the sub-extended segment 411. The sub-bent segment 412 is perpendicular to the sub-extended segment 411. The sub-distal segment 413 is connected to the terminal portion of the sub-bent segment 412. The sub-distal segment 413 is perpendicular to the sub-bent segment 412.

The sub-feeding portion 42 can be connected to a 50Ω coaxial cable. Both the signals receiving and transmitting from the sub-radiation portion 41 are delivered through the 50Ω coaxial cable.

Moreover, one end of the first extension grounding portion 31 is connected to the second extension grounding portion 32. The other end of the first extension grounding portion 31 is connected to the sub-extended segment 411. The sub-antenna unit 4 is connected to grounding, enabling radiation pattern adjustment for the antenna structure M and improving the antenna directivity. The main-antenna unit 2 and the sub-antenna unit 4 commonly share the extension grounding unit 3. Through this method, not only the size of the antenna structure M may be reduced to save precious space on the microwave substrate 1 while improving the antenna efficiency, it also helps to reduce consumption of manufacturing materials and thus save production cost.

The microwave substrate 1 is preferably made from insulating materials and is preferably 0.3 mm to 1 mm in thickness. The main-antenna unit 2, the extension grounding unit 3, and the sub-antenna unit 4 are made from the metal strip, which can be 0.1 mm to 0.3 mm in thickness. The sub-antenna unit 4 may be an antenna operating in compliance with the LTE (Long Term Evolution) communication protocol.

Figure 3:
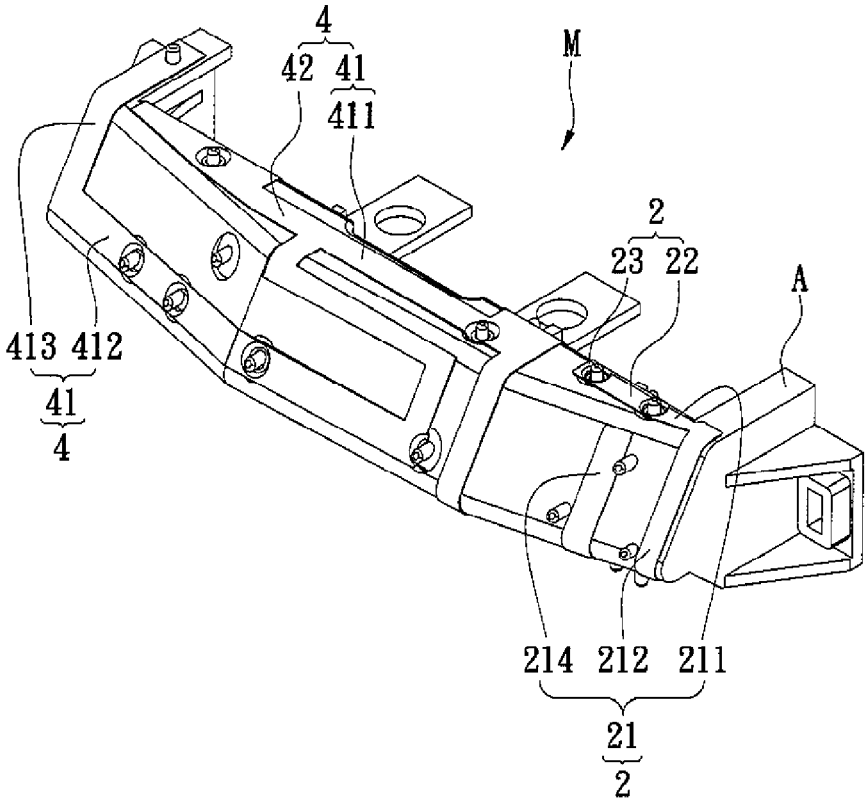
FIG. 3 shows the operation state to the second embodiment of the instant disclosure.
Figure 4:
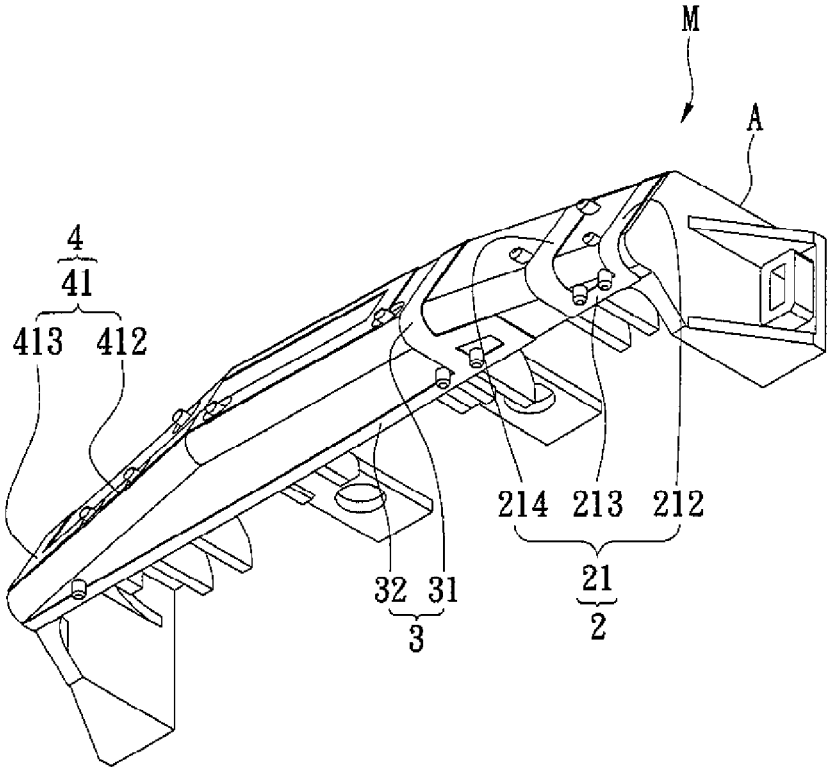
FIG. 4 shows the other vision of the operation state to the second embodiment of the instant disclosure.

Please refer to FIG. 3 and FIG. 4, which illustrate an exemplary application of the antenna in accordance with the instant disclosure. Specifically, the instant figures show the antenna structure M being adapted on the surface of an antenna carrier A. The antenna carrier A may be incorporated in mobile phone, vehicle GPS device, notebook computer, or other kinds of the wireless communication devices.

Figure 5:
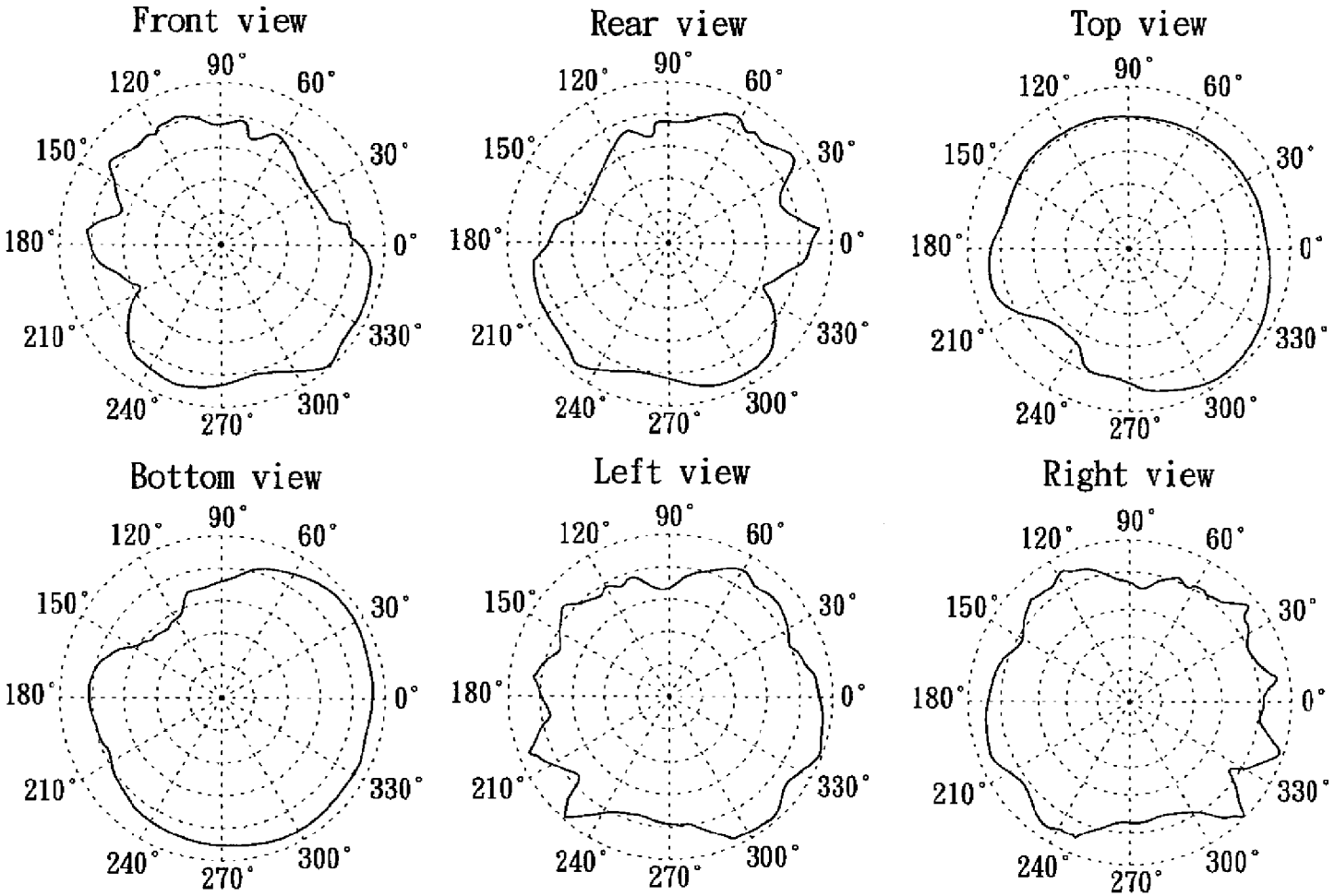
FIG. 5 shows the antenna signal field graph to one of the embodiments of the instant disclosure.

Please refer to the FIG. 5, which shows the antenna radiation patterns of one embodiment of the instant antenna structure. Particularly, we observe an excellent antenna radiation characteristic over conventional designs. Specifically, it is shown that the antenna structure M is capable of excellent overall 360° radiation coverage. Moreover, the experiment results indicate that the antenna structure M has better capability of transmitting and receiving signals than that of most conventional units.

Please refer to the following table, which shows the antenna characteristic test results of the antenna structure M in accordance with the instant disclosure. Particularly, the antenna gain (dB) at each radiation angle (θ and Φ) can meet the specific requirement of various wireless devices.

| | θ | | | | | | | |
|---|---|---|---|---|---|---|---|---|
| Φ | 0 | 30 | 60 | 90 | 120 | 150 | 180 | 210 |
| 30 | −7.7 | −7.2 | −7.1 | −6.9 | −6.6 | −5.6 | −4.3 | −4.3 |
| 60 | −6.6 | −4.5 | −2.5 | −2.0 | −2.0 | −1.9 | −2.1 | −3.1 |
| 90 | −4.0 | −1.9 | −0.4 | −0.9 | −0.5 | 0.5 | 0.5 | −1.1 |
| 120 | −3.6 | −3.4 | −4.4 | −5.6 | −6.1 | −3.3 | −1.7 | −2.2 |
| 150 | −6.0 | −4.1 | −4.1 | −9.8 | −11.1 | −6.5 | −2.6 | −1.5 |

| | θ | | | |
|---|---|---|---|---|
| Φ | 240 | 270 | 300 | 330 |
| 30 | −5.6 | −7.1 | −8.5 | −9.0 |
| 60 | −5.2 | −7.4 | −10.7 | −15.0 |
| 90 | −3.4 | −4.5 | −5.5 | −8.8 |
| 120 | −4.7 | −6.2 | −6.8 | −5.8 |
| 150 | −4.3 | −5.3 | −3.4 | −3.8 |

For direct comparison, the following table shows the same test result for the same antenna structure M with the extension grounding unit 3 removed. It can be observed that, the antenna performance suffers greatly without the extension grounding unit 3.

| | θ | | | | | | | |
|---|---|---|---|---|---|---|---|---|
| Φ | 0 | 30 | 60 | 90 | 120 | 150 | 180 | 210 |
| 30 | −10.5 | −10.8 | −11.7 | −10.5 | −8.4 | −7.5 | −8.0 | −8.5 |
| 60 | −11.2 | −10.0 | −6.7 | −4.9 | −5.6 | −6.4 | −6.7 | −6.8 |
| 90 | −3.6 | −4.2 | −2.7 | −2.5 | −1.3 | −0.7 | −1.2 | −2.4 |
| 120 | −6.6 | −6.7 | −7.6 | −6.9 | −5.9 | −4.3 | −2.9 | −2.8 |
| 150 | −6.0 | −4.3 | −5.0 | −7.7 | −8.2 | −5.0 | −1.9 | −1.2 |

| | θ | | | |
|---|---|---|---|---|
| Φ | 240 | 270 | 300 | 330 |
| 30 | −8.7 | −8.4 | −9.0 | −10.0 |
| 60 | −7.3 | −8.9 | −8.4 | −10.7 |
| 90 | −3.2 | −3.8 | −3.7 | −4.7 |
| 120 | −3.6 | −5.9 | −6.5 | −5.9 |
| 150 | −2.8 | −3.9 | −3.1 | −4.3 |

Through the above test data, we can observe noticeable enhancement in antenna performance by the implementation of the extension grounding unit 3. Specifically, the extension grounding unit 3 improves the antenna gain (dB) at each radiation angle (θ and Φ), especially from 0° to 90°.

Therefore, the extension grounding unit 3 of the instant disclosure can improve the antenna gain at each position angle. So, the antenna structure M has better transition and reception performance.

Based on the above discussions, the instant disclosure has the following advantage: because the antenna structure has the extension grounding unit, the antenna structure can adjust the radiation pattern and improve the antenna directivity. Otherwise, the main-antenna unit and the sub-antenna unit share the extension grounding unit in common. Thus, the antenna structure can reduce the antenna occupied volume and save mass production cost.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following Claims.

What is claimed is:

1. An antenna structure comprising:

a microwave substrate;

a main antenna unit disposed on the surface of the microwave substrate having a main-radiation portion, a main-feeding portion, and a main-grounding portion; and an extension grounding unit disposed on the surface of the microwave substrate having a first extension grounding portion and a second extension grounding portion;

wherein the first extension grounding portion is connected to the second extension grounding portion, and the first extension grounding portion is perpendicular to the second extension grounding portion.

2. The antenna structure of claim 1 wherein the main-antenna unit includes a first section, a second section, a third section, and a fourth section, wherein the second section is connected to the first section, the third section is connected to the second section, the fourth section is connected to the third section.

3. The antenna structure of claim 1 wherein the main-antenna unit and the extension grounding unit are made from metal strips, and the main-antenna unit and the extension grounding unit each has a thickness between 0.1 mm and 0.3 mm.

4. The antenna structure of claim 1 wherein the microwave substrate is made from insulating materials, and the microwave substrate has a thickness between 0.3 mm and 1 mm.

5. An antenna structure comprising:

a microwave substrate;

a main-antenna unit disposed on the surface of the microwave substrate having a main-radiation portion, a main-feeding portion, and a main-grounding portion; and an extension grounding unit disposed on the surface of the microwave substrate having a first extension grounding portion and a second extension grounding portion; and a sub-antenna unit disposed on the surface of the microwave substrate having a sub-radiation portion and a sub-feeding portion;

wherein the first extension grounding portion is connected to the second extension grounding portion, and the first extension grounding portion is perpendicular to the second extension grounding portion.

6. The antenna structure of claim 5 wherein the sub-radiation portion includes a sub-extended segment, a sub-bent segment, and a sub-distal segment, wherein the sub-bent segment is connected to the sub-extended segment, the sub-distal segment is connected to the sub-bent segment.

7. The antenna structure of claim 5 wherein the main-antenna unit, sub-antenna unit and the extension grounding unit are made from metal strips, and the main-antenna unit, the sub-antenna unit, and the extension grounding unit each has a thickness between 0.1 mm and 0.3 mm.

8. The antenna structure of claim 5 wherein the microwave substrate is made from insulating materials, and the microwave substrate has a thickness between 0.3 mm and 1 mm.

* * * * *